US008950164B2

(12) United States Patent
Resta et al.

(10) Patent No.: US 8,950,164 B2
(45) Date of Patent: Feb. 10, 2015

(54) PACKAGING FOR MATTRESSES AND APPARATUS FOR PROVIDING THE PACKAGING

(75) Inventors: Roberto Resta, Faenza (IT); Paolo Resta, Faenza (IT)

(73) Assignee: Resta S.R.L., Faenza (IT)

( * ) Notice: Subject to any disclaimer, the term of this patent is extended or adjusted under 35 U.S.C. 154(b) by 561 days.

(21) Appl. No.: 12/998,957

(22) PCT Filed: Nov. 30, 2009

(86) PCT No.: PCT/EP2009/066071

§ 371 (c)(1),
(2), (4) Date: Jun. 20, 2011

(87) PCT Pub. No.: WO2010/072517

PCT Pub. Date: Jul. 1, 2010

(65) Prior Publication Data

US 2011/0253770 A1 Oct. 20, 2011

(30) Foreign Application Priority Data

Dec. 22, 2008 (IT) ..... BO2008A0764

(51) Int. Cl.

| | |
|---|---|
| ***B65B 11/06*** | (2006.01) |
| ***B65B 51/14*** | (2006.01) |
| ***B65B 9/02*** | (2006.01) |
| ***A47C 31/08*** | (2006.01) |
| *B65B 61/14* | (2006.01) |

(52) U.S. Cl.

CPC ..... *A47C 31/08* (2013.01); *B65B 61/14* (2013.01); *B65B 9/026* (2013.01)

USPC ..... 53/228; 53/373.7

(58) Field of Classification Search

CPC .. B65B 2011/00; B65B 2051/10; B65B 9/00; B65B 9/026; B65B 11/06; B65D 35/245; B65D 75/52; B56B 51/14

USPC ..... 53/204, 373.7, 374.8

See application file for complete search history.

(56) References Cited

U.S. PATENT DOCUMENTS

| | | | | | |
|---|---|---|---|---|---|
| 3,601,826 | A | * | 8/1971 | Smith | 5/499 |
| 3,921,506 | A | * | 11/1975 | Hollis | 493/22 |
| 4,418,514 | A | * | 12/1983 | Spann | 53/436 |
| 4,555,017 | A | * | 11/1985 | Blackmore | 206/83.5 |
| 4,711,067 | A | * | 12/1987 | Magni | 53/439 |
| 5,015,103 | A | * | 5/1991 | Mercer | 383/10 |
| 5,050,742 | A | * | 9/1991 | Muckenfuhs | 206/494 |
| 5,065,868 | A | * | 11/1991 | Cornelissen et al. | 206/494 |
| 5,727,364 | A | * | 3/1998 | Artieda | 53/415 |
| 6,085,370 | A | * | 7/2000 | Lobascio | 5/510 |

(Continued)

FOREIGN PATENT DOCUMENTS

| | | |
|---|---|---|
| DE | 91 17 214 U1 | 4/1997 |
| WO | WO 02/065874 A1 | 8/2002 |

*Primary Examiner* — Gloria R Weeks

(74) *Attorney, Agent, or Firm* — Modiano & Associati; Albert Josif; Daniel J. O'Byrne

(57) ABSTRACT

A packaging for a mattress consisting of a wrapping provided by a sheet of heat-sealing plastics, the wrapping comprising two rectangular portions, which are sized to cover the opposite faces of the mattress and have perimetric regions which are folded so as to cover the perimetric band of the mattress and have, along at least two mutually opposite and parallel sides of the mattress, subflaps which are folded outward and heat-sealed to each other, so as to form wings provided with slots adapted to act as handles.

6 Claims, 7 Drawing Sheets

(56) References Cited

U.S. PATENT DOCUMENTS

| | | | | |
|---|---|---|---|---|
| 6,088,859 | A * | 7/2000 | Cavazos | 5/739 |
| 6,098,378 | A * | 8/2000 | Wyatt | 53/430 |
| 6,178,723 | B1 * | 1/2001 | Mossbeck | 53/450 |
| 6,273,257 | B1 | 8/2001 | Mossbeck | |
| 6,481,188 | B1 * | 11/2002 | Graham et al. | 53/479 |
| 6,502,375 | B2 * | 1/2003 | Resta | 53/575 |
| 7,383,676 | B1 | 6/2008 | Schmidt | |
| 7,458,193 | B2 * | 12/2008 | Andria et al. | 53/436 |
| 7,581,772 | B2 * | 9/2009 | Johnson et al. | 294/152 |
| 7,585,007 | B2 * | 9/2009 | Johnson et al. | 294/152 |
| 7,828,354 | B2 * | 11/2010 | Kohn et al. | 294/152 |
| 7,828,355 | B2 * | 11/2010 | Kohn et al. | 294/152 |
| 7,895,813 | B2 * | 3/2011 | Andria et al. | 53/399 |
| 8,096,234 | B2 * | 1/2012 | Rivard | 100/35 |
| 8,113,558 | B2 * | 2/2012 | Johnson et al. | 294/152 |
| 8,157,095 | B2 * | 4/2012 | Motsch | 206/494 |
| 8,231,029 | B2 * | 7/2012 | Peer et al. | 220/754 |
| 8,342,587 | B2 * | 1/2013 | Johnson et al. | 294/152 |
| 2006/0012200 | A1 | 1/2006 | Kohn | |

* cited by examiner

PACKAGING FOR MATTRESSES AND APPARATUS FOR PROVIDING THE PACKAGING

The present invention relates to a packaging for mattresses and to an apparatus for providing the packaging.

BACKGROUND OF THE INVENTION

It is known to protect mattresses against dust and damage caused by the handling that they undergo during transport and sorting in warehouses. To protect the mattresses, hermetic packaging is provided, consisting of a sheet of plastics that is wrapped around them and closed by heat-sealing.

However, the packaging currently in use does not allow a comfortable grip of the mattresses due to the fact that the sheet of plastics is normally stretched around the mattress and does not offer holds for gripping it and handling it.

SUMMARY OF THE INVENTION

The aim of the present invention is to propose a packaging that is capable of obviating the drawbacks of known packagings, i.e., is conceived so that it can be handled more conveniently by assigned personnel as regards both horizontal and lifting movements.

Within this aim, an object of the present invention is to provide a packaging which is provided without having to resort to auxiliary means but by intervening only on the sheet of plastic material that is wrapped around the mattress.

This aim and this and other objects which will become better apparent hereinafter are achieved with a packaging for a mattress consisting of a wrapping provided by means of a sheet of heat-sealing plastics, characterized in that said wrapping comprises two rectangular portions, which are sized to cover the opposite faces of the mattress and have perimetric regions which are folded so as to cover the perimetric band of the mattress and have, along two mutually opposite and parallel sides of the mattress, subflaps which are folded outward and heat-sealed to each other, so as to form wings provided with slots adapted to function as handles.

The above aim is also achieved with an apparatus for packaging a mattress with a sheet of heat-sealing plastic material unwound from at least one reel, characterized in that it comprises a mattress handling table which is composed of a first conveyor for the advancement of the mattress and a second conveyor for receiving the mattress, said conveyors being mutually separated by an opening, folding means for stretching across said opening a portion of said sheet of heat-sealing plastic material, means for actuating said conveyors to transfer said mattress from the advancement conveyor to the receiving conveyor so as to fold the sheet, by said folding means, so that said sheet covers the opposite faces of the mattress with an upper portion and a lower portion, which have perimetric regions adapted to cover the perimetric band of the mattress with flaps that are folded outward, first heat-sealing means which are actuated to join the flaps of each side that is perpendicular to the advancement direction of the mattress with two parallel heat-sealing lines, so as to close in a loop said sheet around said mattress, and second heat-sealing means for joining the two remaining flaps and forming a closed wrapping for containing said mattress, cutting means for splitting said sheet between said two parallel heat-sealing lines, and punching means for forming slots in the flaps of at least one side of said wrapping.

BRIEF DESCRIPTION OF THE DRAWINGS

Further characteristics and advantages of the present invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
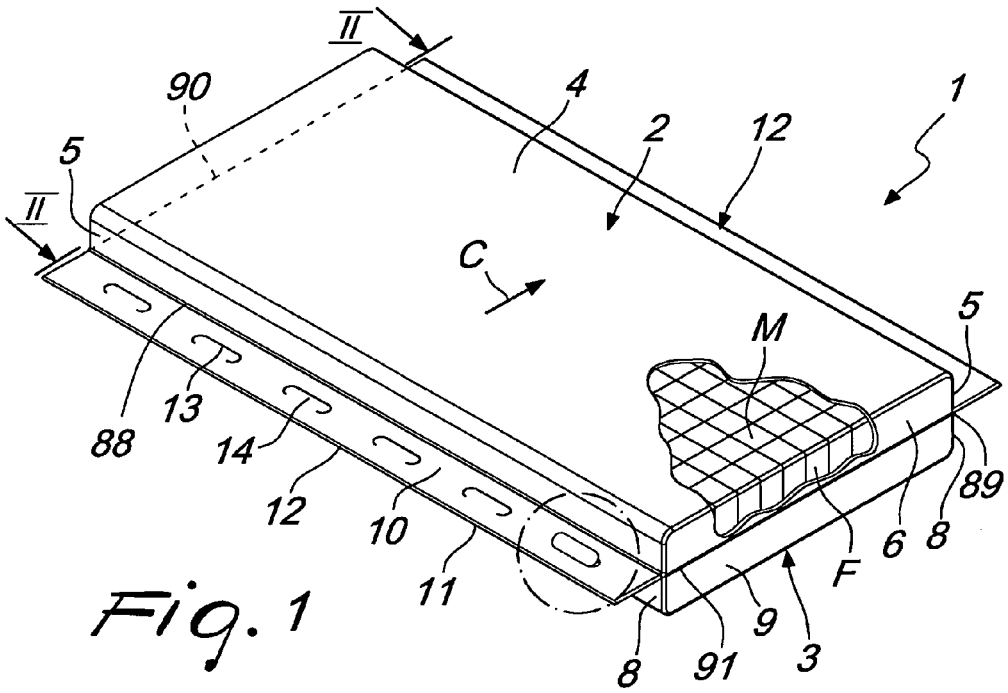
FIG. 1 is a perspective view of a packaged mattress.
Figure 2:
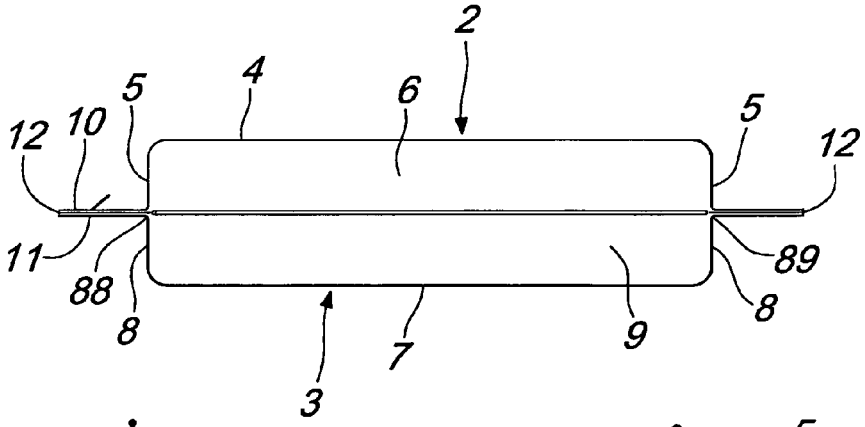
FIG. 2 is a view of the mattress taken along the line II-II of FIG.
Figure 3:
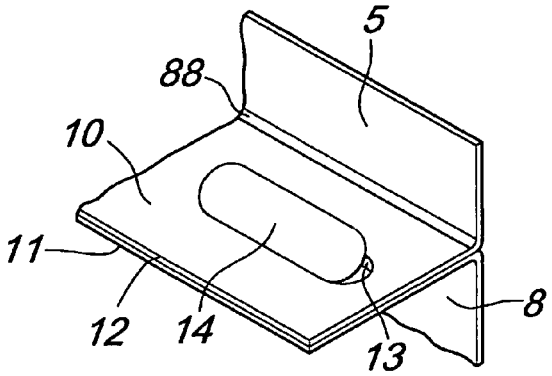
FIG. 3 is an enlarged-scale view of the detail enclosed in the circle of FIG. 1.

With reference to FIGS. 1-3, a packaging according to the invention consists of a wrapping, which is generally designated by the reference numeral 1 and is provided by using a sheet of heat-sealing plastic material that is wrapped around a mattress M so as to close the latter in a hermetic bank that copies the parallelepipedal shape of the mattress.

The wrapping 1 can be thought of as being composed of two parts which are mutually coupled and are referred to hereinafter, for the sake of convenience in description, as rectangular halves 2, 3 which are mutually heat-sealed. More precisely, the upper half 2 comprises a rectangular region 4, which covers the upper face of the mattress M and has perimetric flaps 5, 6 which extend from the long sides and the short sides, respectively, of the region 4 toward the lower half, partially covering the lateral peripheral band F of the mattress. Likewise, the lower valve 3 comprises a rectangular region 7, which covers the lower face of the mattress M and has lateral flaps 8, 9, which extend from the long sides and the short sides, respectively, of the region 7 and complete the covering of the remaining part of the peripheral band F of the mattress.

The important advantage of the packaging according to the invention consists in the presence of handles formed during the formation of the wrapping 1. For this purpose, the peripheral flaps of the wrapping 1, preferably the flaps 5, 8 that extend along the two long sides of the mattress, are provided with subflaps 10, 11, which project laterally at right angles with respect to the flaps 5, 8 and are mutually heat-sealed so as to form two wings 12 of double thickness which protrude from the two long and opposite sides of the wrapping. In practice, a series of elongated slots 13 are punched simultaneously with the formation of the wings 12, said slots constituting the handles to be used for the manual displacements to which the mattress is subjected for lifting, storage and transport.

Advantageously, the punching provides only for a partial cutting of the slots 13, so that a tab 14 remains attached inside them and makes it possible to obtain a handle that can offer a more comfortable and safe grip.

Figure 4:
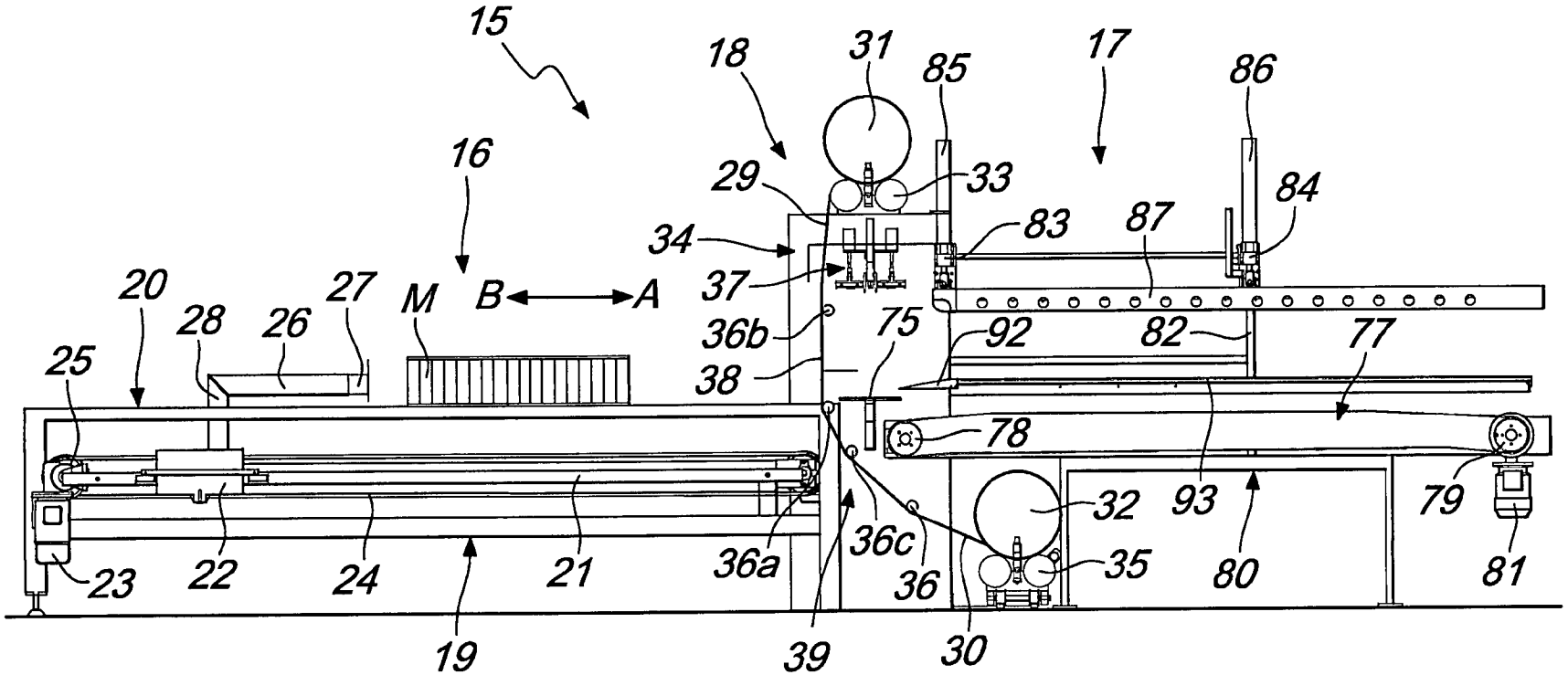
FIG. 4 is a side elevation view of the apparatus for providing the packaging of the mattress of FIGS. 1-3.
Figure 5:
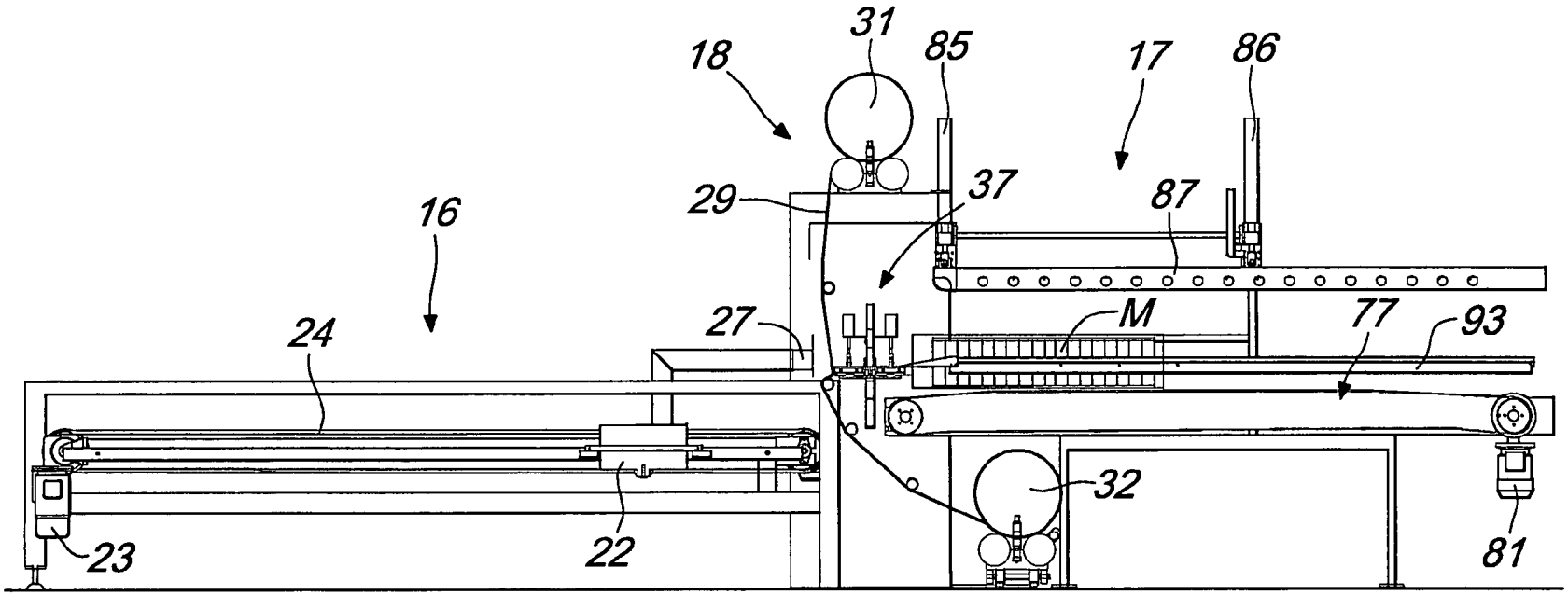
FIGS. 5 and 6 are two views of the apparatus of FIG. 4 in two successive operating situations.
Figure 6:
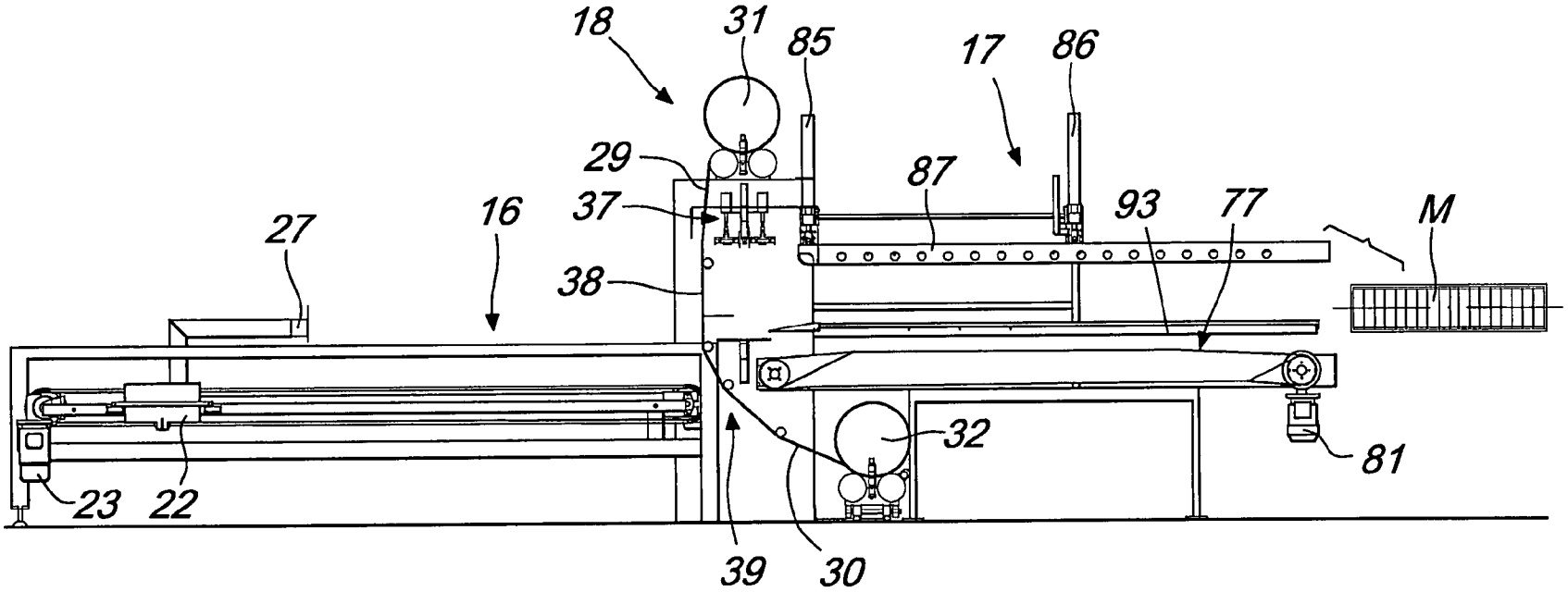
Figure 7:
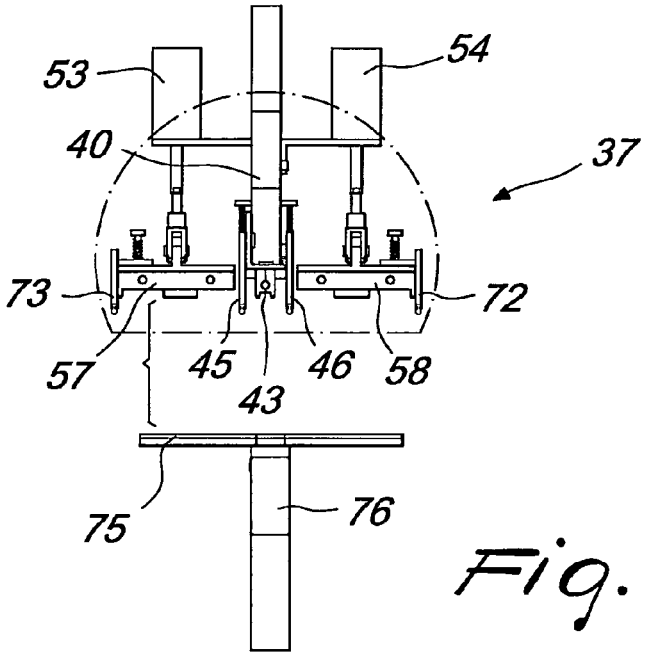
FIG. 7 is a view of the packaging heat-sealing and punching assembly alone.
Figure 8:
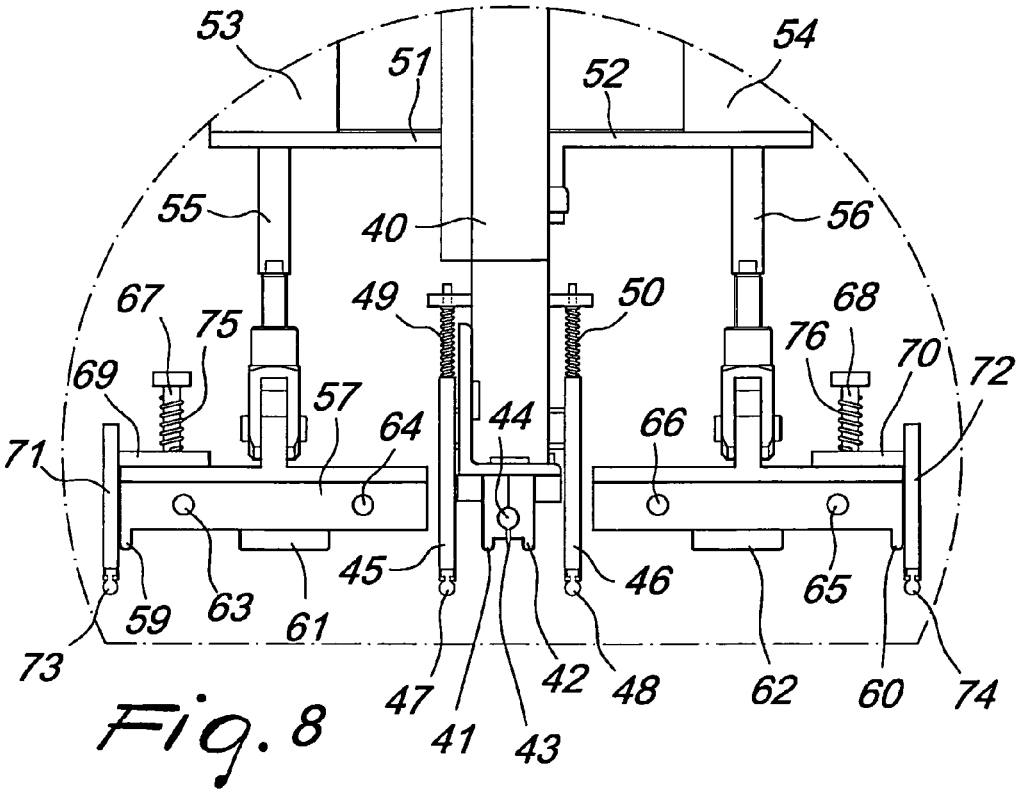
FIG. 8 is an enlarged-scale view of the heat-sealing and punching elements of the assembly of FIG. 7.
Figures 9, 10:
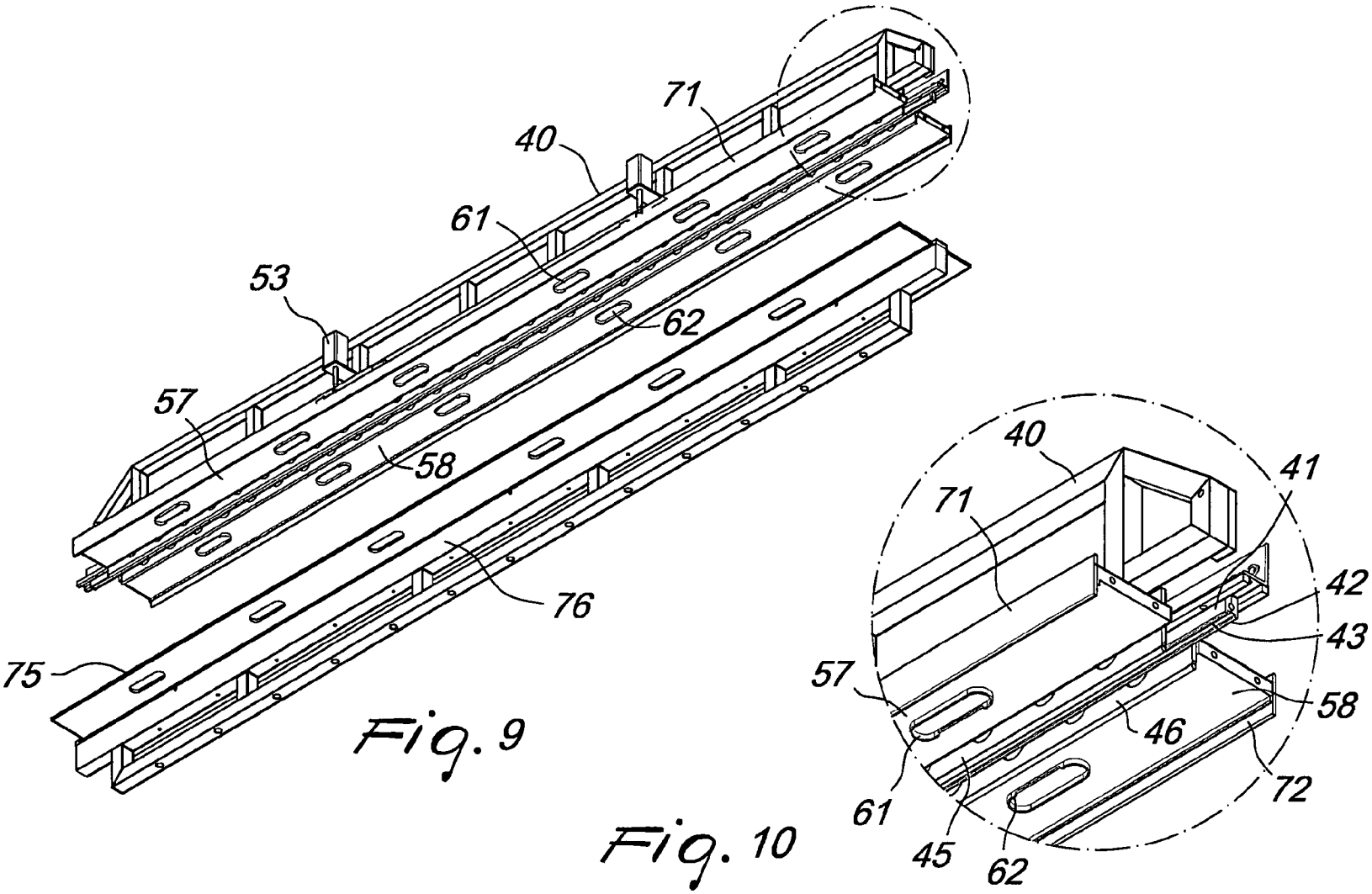
FIG. 9 is a perspective view of the elements for heat-sealing and punching the packaging.
FIG. 10 is an enlarged-scale view of the detail enclosed in the circle of FIG. 9.

The apparatus that, according to a further embodiment, makes it possible to provide the packaging described above is generally designated by the reference numeral 15 and is described hereinafter with reference to FIG. 4. It is composed of two functional assemblies 16 and 17, which are designed to cause the advancement and reception of the mattress M and between which a third functional assembly 18 is arranged which is designed to close the wrapping 1 that constitutes the packaging.

The first assembly 16 comprises a frame 19, which is composed of longitudinal members which are connected by cross-members and supported on the ground by means of uprights.

The frame 19 supports a table 20, which provides support for the mattress to be packaged and below which horizontal sliding guides 21 are arranged for a slider 22 which is actuated by means of a motor drive composed of a reversible gear motor 23, which actuates a chain 24 closed in a loop around toothed pulleys 25 and connected to the slider 22 for moving it forward and backward in the direction A-B. A pusher 26 is fixed on the slider 22 and, together with the table 20, constitutes a conveyor for the advancement of the mattress M toward the functional assembly 18, as will become better apparent in the continuation of the description.

The pusher 26 consists of a bar 27, which is oriented at right angles to the direction A-B, is parallel to the table 20 and is fixed to an L-shaped arm 28, which rises from the slider 22 on which it is fixed. With the actuation of the gearmotor 23, the arm 28 moves along a slot of the table 20 which is parallel to the sliding direction A-B of the slider, while the bar 27 of the pusher 26, being perpendicular to said direction and moving above the table 20, can push the mattress M to be packaged toward the assembly 18 once it has been deposited on the table 20 by feeder means, not shown in the figures.

The assembly 18 is provided with means which spread and wrap the sheet of material with which the wrapping 1 is formed around the mattress M.

In the example of apparatus shown, the sheet to be wrapped around the mattress is obtained by connecting through heat-sealing the initial ends of two sheets 29, 30 unwound from two respective reels 31, 32. The reel 31 is supported by a pair of rollers 33, which are mounted on the top of the frame 34 of the functional assembly 18 at a height which lies above the mattress supporting table 20. Likewise, the second reel 32 is supported by a pair of rollers 35 at a height that lies below the mattress supporting table 20. The two sheets 29, 30, which unwind from the respective reels 31, 32, are guided by a plurality of rollers 36, 36*a*, 36*b*, 36*c*, which are supported rotatably in the frame 34 and act as guiding and folding elements. In particular, the roller 36*a* is arranged at the exit of the supporting table 20 below the roller 36*b*, so as to guide the sheet 29 vertically. In FIG. 4, the sheets 29, 30 are shown already joined by a heat-sealing assembly 37 which is arranged downstream of the sheets 29, 30, so as to form a single sheet which, for the sake of convenience in description, is designated ideally by the reference numeral 38 and remains continuous during the packaging process until the wrapping 1 is split.

In view of the position of the reels 31, 32 above and below the resting table 20, respectively, and of the continuity of the sheet 38 between the reels 31, 32, the advancement conveyor 16 is necessarily separated from the receiving container 17, so that a space or opening 39 remains formed between them which allows the sheets 29, 30 to remain connected during the packaging of subsequent mattresses after they have been heat-sealed by the heat-sealing assembly 37.

The heat-sealing assembly 37 (see FIGS. 7-10) consists of a horizontal beam 40, which is arranged at a right angle to the direction A-B and can move vertically by means of actuators, preferably of the pneumatic type, which are supported in any desired manner in the frame 34 and are not shown in the drawings.

A pair of heat-sealing bars 41, 42 is jointly connected to the beam 40 in a lower region, and a blade 43 is fixed between them. The blade 43 and the heat-sealing bars 41, 42 are heated by a resistor 44, which is incorporated between them. Respective strips 45, 46 are supported at the sides of the beam 40, and gaskets 47, 48 made of heat-resistant elastic material are attached to their lower edge. The strips 45, 46 are guided vertically and are actuated downward by springs 49, 50, which abut against the beam 40. When said beam is in the raised position, the blade 43 remains recessed between the strips 45, 46, whose gaskets 47, 48, due to the action of the springs 49, 50, protrude below the blade 43.

Brackets 51, 52 are jointly connected to the beam 40 and protrude laterally from it; pneumatic jacks 53, 54 are mounted on said brackets. The stems 55, 56 of the jacks extend downward, and two rectangular plates 57, 58 are coupled thereto and are adjacent to the beam. The plates 57, 58 have outer edges that form the outer heat-sealing bars 59, 60, which protrude downward for performing two parallel heat seals which are spaced from cutting plane of the blade 43.

The plates 57, 58, in the central region comprised between the heat-sealing bars 59, 60 and the straps 45, 46, have elliptical ribs 61, 62, which together with the heat-sealing bars 59, 60 are heated by resistors 63, 64 and 65, 66 incorporated in the plates 57, 58. The ribs 61, 62 constitute a sort of punches, which cut by melting the sheets of plastic material and forming the slots 13 in the wings 12 of the enclosure. The ribs 61, 62, however, are not closed in a loop, but lack a portion, so that the punching of the wings produces the tabs 14 (see FIG. 3).

Pins 67, 68 are fixed to the plate regions 57, 58 and extend vertically, and L-shaped members 69, 70 are guided thereon. Strips 71, 72 are connected to said L-shaped members at right angles, are adjacent to the external edge of the plate regions 57, 58 and are provided with gaskets 73, 74 made of heat-resistant elastic material. The strips 71, 72 are actuated downward by means of springs 75; 76, which are interposed between the L-shaped members 69, 70 and the heads of the pins 67, 68.

The heat-sealing assembly 37 comprises an abutment element 75 for the strips 45, 46 and 71, 72 and the heat-sealing bars 41, 42 and 59, 60, as well as for the blade 43. The element 75 consists of a plate which is supported by a bar 76 fixed to the frame 34 and is covered with a layer of a material that withstands the heat-sealing temperature, for example a material known commercially under the trademark Teflon.

The receiving assembly 17, arranged downstream of the heat-sealing assembly 37, consists of a conveyor 77 of the single-belt type or of the type with narrow belts (see FIG. 4), which form a wide belt that is closed in a loop around rollers 78, 79 supported by a frame 80 and actuated by a gearmotor 81. The conveyor 77 has a horizontal upper portion, which lies substantially on the plane of the abutment plate 75 and laterally to which the shoulders 82 of the frame 80 rise. The shoulders 82 are mutually connected by a pair of cross-members 83, 84, which are perpendicular to the direction A-B and on each of which a pair of jacks 85, 86, preferably of the pneumatic type, is fixed. The stems of the jacks 85, 86 arranged on each side of the conveyor 77 and therefore parallel to the direction A-B support respective heat-sealing bars 87, which after the activation of the heat-sealing bars 41, 42 and 59, 60 of the heat-sealing assembly 37 close the enclosure 2 with heat-sealing lines 88, 89 and 90, 91, of which the first ones 88, 89 (see FIG. 1) extend along the angles formed by the flaps 5, 8 with the wings 12 and the second ones 90, 91 connect the edges of the flaps 6, 9. It should be noted that in order to allow the heat-sealing of the lateral flaps 6, 9 there are deflection elements 92, which fold outward the lateral flaps 6, 9 and then arrange them on top of each other on respective bars 93, which act as abutments for the heat-sealing bars 87. In this manner, a guaranteed heat-sealing of the flaps 6, 9 is obtained, forming an outer lip of irrelevant protrusion, which is not shown in the figures.

The operation of the apparatus is described hereinafter starting from the situation shown in FIG. 4, in which it is assumed, as mentioned above, that the sheets 29, 30 are already connected so as to form a sheet 38 by the heat-sealing line 89 provided in preceding operating steps and referred to hereinafter as the front sealing line. It is further assumed that the mattress M is oriented transversely on the resting table 20, i.e., with the longer side at a right angle to the direction A-B. Upon actuation of the slider 22 by means of the gearmotor 23, the pusher 27 pushes the mattress M in the direction C (see FIG. 1) against the portion of the sheet 38 that is comprised between the roller 36*a*, which is arranged at the outlet of the table 20, and the roller 36*b*, which is arranged above the table 20 at a height that is greater than the thickness of the mattress. Accordingly, the rollers 36*a*, 36*b* act as folding elements, so that the sheet 38, as it is progressively unwound, folds over onto itself, covering the upper and lower faces of the mattress. When the mattress M has moved onto the conveyor 77, the descent of the heat-sealing assembly 37 is actuated and produces, by means of the abutment of the heat-sealing bar 60 against the plate 75, the closure of the sheet 38 in a loop around the mattress M, forming the rear heat-sealing line 88 (see FIG. 1) and, by means of the abutment of the rear heat-sealing bar 59 against the plate 75, the connection of the two sheets 29, 30, forming the front heat-sealing line 89 of the wrapping designed to be wrapped around the next mattress.

Simultaneously with the formation of the heat-sealing lines, the punches 61, 62 cut the slots 13, while the pressing strips 45, 46, having reached abutment against the plate 75, retain the two sheets 29, 30 so that they are superimposed on the latter, so as to allow the blade 43 to perform a clean central cut, forming the subflaps 11, 12 and, by heat sealing, two wings 12, each provided with slots 13. At this point, the heat-sealing assembly 37 is again lifted so as to allow the positioning of the mattress between the heat-sealing bars 87, which perform the complete peripheral closure of the wrapping, joining the lateral flaps 6, 9 by means of the heat-sealing lines 90, 91.

The operating cycle of the apparatus is thus ended and can be repeated in the manner described above to perform the packaging of the next mattress, which in the meantime has been transferred onto the supporting table 20.

Figure 11:
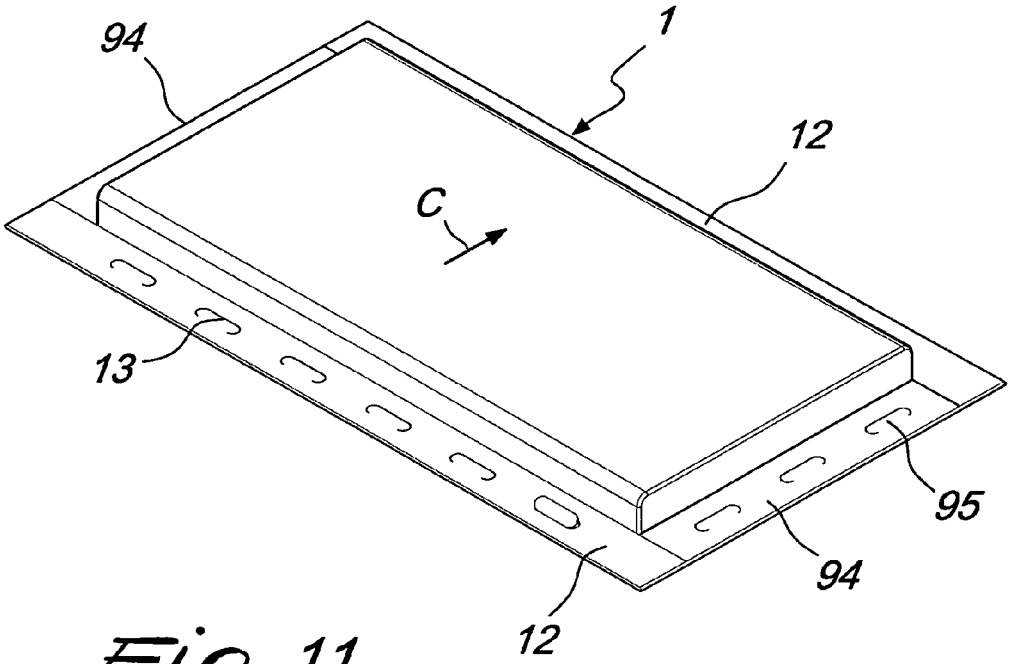
FIGS. 11 and 12 are two perspective and plan views of a mattress that is packaged according to a further embodiment.
Figure 12:
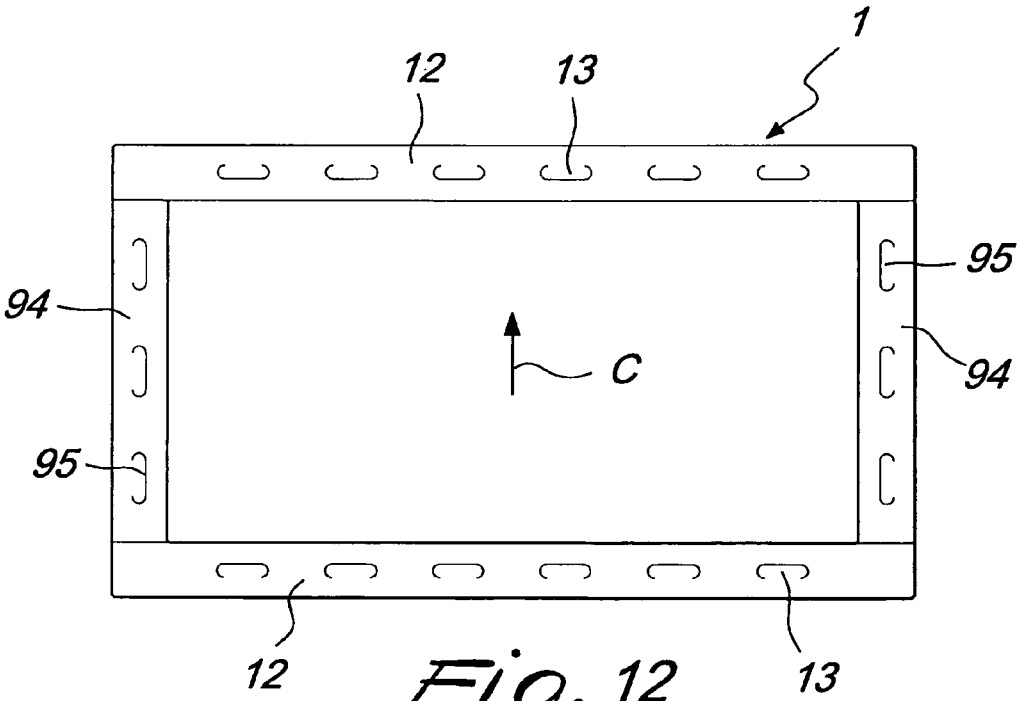

The described apparatus is susceptible of numerous modifications and variations, all of which are within the scope of the appended claims. A first variation consists in associating with the longitudinal heat-sealing bars 87 plates which have die-cutting punches and pressers which are functionally identical to the ones of the example described above, so as to allow the formation of wings 94 which are provided with slots 95 also along the sides of the mattress that are parallel to the direction C, and to thus obtain handles along the entire perimeter of the mattress, as shown in FIGS. 11 and 12.

In a second variation, the packaging sheet is taken from a single reel. For this purpose, for the application of the sheet around the mattress there are means according to what is disclosed in EPA 09172295.9 in the name of this same Applicant and referenced herein as an integral part of the present invention.

A third variation of the invention consists in providing a presser, which is designed to compress and reduce the thickness and therefore the space occupation of the mattress. Advantageously, the presser substantially consists of a plate whose dimensions are complementary to those of the mattress M and which is movable between the heat-sealing bars 87 by means of jacks which are supported on the frame 80 according to what is described in the above cited application.

The disclosures in Italian Patent Application No. BO2008A000764 from which this application claims priority are incorporated herein by reference.

What is claimed is:

1. An apparatus for packaging a mattress with a sheet of heat-sealing plastic material unwound from at least one reel, comprising a mattress moving table which is composed of a first conveyor for the advancement of the mattress and a second conveyor for receiving the mattress, said conveyors being mutually separated by an opening, folding means for stretching a portion of said sheet of heat-sealing plastics sheet across said opening, means for actuating said conveyors to transfer said mattress from the advancement conveyor to the receiving conveyor so as to fold the sheet, by said folding means, so that said sheet covers the opposite faces of the mattress with an upper portion and a lower portion, which have perimetric regions suitable to cover the perimetric band of the mattress with flaps that are folded outward, first heat-sealing means which are actuated to join the flaps of each side that is perpendicular to the advancement direction of the mattress with two parallel heat-sealing lines, so as to close in a loop said sheet around said mattress, and second heat-sealing means for joining the two remaining flaps and forming a closed wrapping for containing said mattress, cutting means for splitting said sheet between said two parallel heat-sealing lines, and wherein punching means are provided for forming slots in the flaps of at least one side of said wrapping wherein said slots are only partially cut such that a tab remains attached inside said slots, and wherein said first heat-sealing means consist of an assembly, which is arranged behind said sheet and comprises a support, which can move vertically by means of actuators, a pair of heat-sealing bars which are coupled to said support transversely to the advancement direction of the mattress, a blade which is fixed between said heat-sealing bars, an abutment plate for said bars and said blade, presser elements which are guided vertically on said support at the sides of said heat-sealing bars and consists of strips which are actuated by elastic means so that when the support is in the raised position said blade remains recessed between said strips and the edge of said strips protrudes below said blade, and wherein actuators are arranged on said support for actuating a pair of plate-like elements, whose internal edges are adjacent to said strips and whose external edges form heat-sealing bars which protrude downward for performing heat seals which are parallel and equidistant with respect to the cutting plane of said blade.

2. The apparatus according to claim 1, wherein said second heat-sealing means comprise abutment elements for two heat-sealing bars, which are arranged on the receiving conveyor and are actuated by actuators for joining the lateral flaps of the wrapping.

3. The apparatus according to claim 2, wherein between the heat-sealing bars of said receiving conveyor there is a presser element, which consists of a plate whose dimensions are substantially complementary to the dimensions of the mattress and which plate is actuated so as to keep the mattress compressed during the formation of the wrapping.

4. The apparatus according to claim 1, wherein said second heat-sealing means are adapted to form wings provided with slots also along the sides of the mattress perpendicular to said parallel heat-sealing lines to obtain handles along the entire perimeter of the mattress.

5. An apparatus for packaging a mattress with a sheet of heat-sealing plastic material unwound from at least one reel, comprising a mattress moving table which is composed of a first conveyor for the advancement of mattress and a second conveyor for receiving the mattress, said conveyors being mutually separated by an opening, folding means for stretching a portion of said sheet of heat-sealing plastics sheet across said opening, means for actuating said conveyors to transfer said mattress from the advancement conveyor to the receiving conveyor so as to fold the sheet, by said folding means, so that said sheet covers the opposite faces of the mattress with an upper portion and a lower portion, which have perimetric regions suitable to cover the perimetric band of the mattress with flaps that are folded outward, first heat-sealing means which are actuated to join the flaps of each side that is perpendicular to the advancement direction of the mattress with two parallel heat-sealing lines, so as to close in a loop said sheet around said mattress, and second heat-sealing means for joining the two remaining flaps and forming a closed wrapping for containing said mattress, cutting means for splitting said sheet between said two parallel heat-sealing lines, and wherein punching means are provided for forming slots in the flaps of at least one side of said wrapping wherein said slots are only partially cut such that a tab remains attached inside said slots, and wherein said first heat-sealing means consist of an assembly, which is arranged behind said sheet and comprises a support, which can move vertically by means of actuators, a pair of heat-sealing bars which are coupled to said support transversely to the advancement direction of the mattress, a blade which is fixed between heat-sealing bars, an abutment plate for said bars and said blade, presser elements which are guided vertically on said support at the sides of said heat-sealing bars and consist of strips which are actuated by elastic means so that when the support is in the raised position said blade remains recessed between said strips and the edge of said strips protrudes below said blade, and wherein actuators are arranged on said support for actuating a pair of plate-like elements, whose internal edges are adjacent to said strips and whose external edges form heat-sealing bars which protrude downward for performing heat seals which are parallel and equidistant with respect to the cutting plane of said blade, and wherein said plates, in the central region comprised between said heat-sealing bars and said strips, have ribs, which are adapted to engage on said abutment element for forming said slots in said wings of the wrapping.

6. An apparatus for packaging a mattress with a sheet of heat-sealing plastic material unwound from at least one reel, comprising a mattress moving table which is composed of a first conveyor for the advancement of the mattress and a second conveyor for receiving the mattress, said conveyors being mutually separated by an opening, folding means for stretching a portion of said sheet of heat-sealing plastics sheet across said opening, means for actuating said conveyors to transfer said mattress from the advancement conveyor to the receiving conveyor so as to fold the sheet, by said folding means, so that said sheet covers the opposite faces of the mattress with an upper portion and a lower portion, which have perimetric regions suitable to cover the perimetric band of the mattress with flaps that are folded outward, first heat-sealing means which are actuated to join the flaps of each side that is perpendicular to the advancement direction of the mattress with two parallel heat-sealing lines, so as to close in a loop said sheet around said mattress, and second heat-sealing means for joining the two remaining flaps and forming a closed wrapping for containing said mattress, cutting means for splitting said sheet between said two parallel heat-sealing lines, and wherein punching means are provided for forming slots in the flaps of at least one side of said wrapping wherein said slots are only partially cut such that a tab remains attached inside said slots, and where said first heat-sealing means consist of an assembly, which is arranged behind said sheet and comprises a support, which can move vertically by means of actuators, a pair of heat-sealing bars which are coupled to said support transversely to the advancement direction of the mattress, a blade which is fixed between said heat-sealing bars, an abutment plate for said bars and said blade, presser elements which are guided vertically on said support at the sides of said heat-sealing bars and consist of strips which are actuated by elastic means so that when the support is in the raised position said blade remains recessed between said strips and the edge of said strips protrudes below said blade, and wherein actuators are arranged on said support for actuating a pair of plate-like elements, whose internal edges are adjacent to said strips and whose external edges form heat-sealing bars which protrude downward for performing heat seals which are parallel and equidistant with respect to the cutting plane of said blade, and wherein presser elements are guided vertically on said plates and consist of strips which are adjacent to the outer edge of said plates, said strips being actuated by elastic means so as to engage against said abutment element.

* * * * *